US010118758B2

(12) United States Patent
Purliyev

(10) Patent No.: US 10,118,758 B2
(45) Date of Patent: Nov. 6, 2018

(54) FLOATABLE INFUSION PACKAGE

(75) Inventor: Marat Purliyev, Ashgabat (TM)

(73) Assignee: Marat Purliyev (TM)

( * ) Notice: Subject to any disclaimer, the term of this patent is extended or adjusted under 35 U.S.C. 154(b) by 131 days.

(21) Appl. No.: 12/340,764

(22) Filed: Dec. 22, 2008

(65) Prior Publication Data

US 2010/0159076 A1 Jun. 24, 2010

(51) Int. Cl.
*B65B 29/02* (2006.01)
*B65B 29/04* (2006.01)
*B65D 85/812* (2006.01)

(52) U.S. Cl.
CPC ..... *B65D 85/812* (2013.01)

(58) Field of Classification Search
CPC ..... B65D 85/812; B65D 85/808; B65D 2203/12; B65B 29/02
USPC ..... 426/79, 82, 83; 99/316, 320, 322, 323; 206/0.5
See application file for complete search history.

(56) References Cited

U.S. PATENT DOCUMENTS 2,879,613 A * 3/1959 De Mario ..... 40/324
3,809,215 A 5/1974 Dobry
6,733,804 B1 * 5/2004 Lohrey et al. ..... 426/79
2005/0208181 A1 * 9/2005 Greco et al. ..... 426/77
2005/0247207 A1 * 11/2005 Saint ..... 99/323

FOREIGN PATENT DOCUMENTS

CA 1002001 12/1976
GB 1436397 5/1976

* cited by examiner

*Primary Examiner* — Jeffrey P Mornhinweg
(74) *Attorney, Agent, or Firm* — Berenato & White, LLC

(57) ABSTRACT

One embodiment of an infusion package comprises a prepared raw material compartment (10) formed by sealed partitions (12) and (14) and containing prepared raw material (16). Partition (14) separates compartment (10) from a flotation compartment (18) filled with flotation material (20) to cause the package envelope to float in a liquid. Any floatable material which is inert and harmless in the liquid, or a gas bubble sealed in a liquid-tight bag can serve as flotation material. A sealed envelope top (22) carries advertising materials, though advertising labels can be attached to its surface as an option. One end of a string (24) is attached to top (22) and the other—to a conventional label (26). The package envelope can be agitated and removed from the liquid with the help of top (22) or string (24). The envelope can be entirely or in part of a liquid-permeable, heavier-, or lighter-than-liquid, inert and harmless material like paper, fabric, plastic net, perforated plastic film, etc. Other embodiments are described and shown. All embodiments are easy and trouble-free in production, storage and use.

23 Claims, 1 Drawing Sheet

FLOATABLE INFUSION PACKAGE

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND

Field

This application generally relates to infusion packages intended for infusion, dissolution, or brewing of prepared raw materials contained within the packages. The packages are of the type that are immersed in an extracting liquid, especially infusion tea packages that are immersed in water.

Prior Art

Previously, it has been found that infusion of the contents of a tea package in hot water occurs more quickly and completely if the package does not lie at the bottom of a cup, but floats in the upper layers of the water. This could be attributed to the following: (1) the upper layers of the water have higher temperatures than the layers near the bottom, (2) the part of the package which contacts the bottom, now contacts only water and hence is fully involved in the infusion process, (3) water layers surrounding the package are stirred more freely by convection.

Several attempts were made to assure floatation of an infusion package near the surface of an extracting liquid. U.S. Pat. No. 3,809,215 to Dobry (1974) discloses an infusion package with light-weight floatation means fastened to the upper surface of the package. U.K. patent 1,436,397 to Rodrigues-Ely (1976) describes a beverage infusion device with a float proportioned to cover a major portion of water surface in a drinking vessel and attached to an infusion package. Both devices have external floatation means attached to the packages but both make the production technology of the packages more complicated and expensive, as new materials and unusual operations are involved. Moreover, the use of the packages becomes somewhat tricky, as there is always a risk that pieces of the floatation means may detach and litter the surface of the beverage.

Canadian patent 1,002,001 to Rodriques-Ely and Joannou (1976) shows an infusion filter which floats horizontally due either to floatable particles mixed with the infusible material, or to floatable disks attached to the inside of the upper wall of the filter. This eliminates the mentioned risk of the beverage littering by the floatation means pieces. Nevertheless it suffers from the following disadvantages:

(1) the material of the floatable particles and disks must be special, as it should be inert not only to water, but also to the infusible material that shares the same compartment with the floatable particles or disks, both during the storage and use of the package;

(2) the floatable particles or disks, which closely contact the infusible material during the storage, will inevitably catch some particles of the material during infusion, thus preventing their full contact with water and therefore hindering the infusion process;

(3) the production technology of the package with the floatable disks is significantly different, more complicated, and expensive in comparison with conventional technology, as it includes manufacturing of the disks and their attachment to the inner wall of the package.

To the best of my knowledge, none of the devices mentioned in these patents have been manufactured or put into practice. I believe that this is because of the mentioned disadvantages, i.e., the infusion package has the floatation means outside the package, and its technological and storage requirements are non-conventional.

SUMMARY

In accordance with one embodiment, an infusion package comprising an envelope subdivided into plurality of compartments arranged in a single layer, at least one of the compartments being a prepared raw material compartment containing a predetermined quantity of prepared raw material adapted to be immersed into a liquid for infusion of the material also comprising floatation material assuring floatation of the package envelope in the liquid. The infusion package comprises at least one floatation compartment containing floatation material only. The infusion package can further include means for its agitation and removal from the liquid and carry advertising materials.

DRAWINGS—FIGURES

DRAWINGS—REFERENCE NUMERALS

Figure 1:
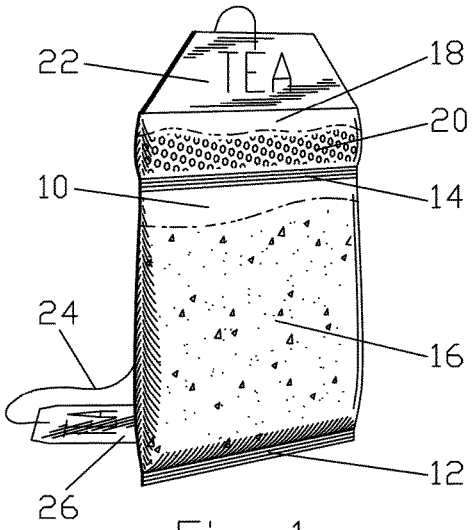
FIG. 1 is a perspective view of one embodiment of an infusion package.

10, 10A, 10B, 10C prepared raw material compartment
12, 12A, 12B, 14, 14A, 14B, 14C sealed partition
16 prepared raw material
18, 18A, 18B, 18C flotation compartment
20 flotation material
22 sealed envelope top
24 string
26 label
28 liquid
30 round pad

DETAILED DESCRIPTION—FIRST EMBODIMENT—FIG. 1

FIG. 1 shows an infusion package made of a liquid-permeable flat paper sleeve. Any heavier- or lighter-than-liquid, inert and harmless material like fabric, plastic net, or perforated plastic film can be used as an alternative material. The package is shown in the position it actually assumes during its operation. The package comprises a prepared raw material compartment 10 formed by sealed partitions 12 and 14 and containing a prepared raw material 16, such as tea or a herbal infusion within. Partition 14 separates compartment 10 from a flotation compartment 18 filled with flotation material 20. Pieces of cork or plastic, or other floatable material which is inert and harmless in a liquid, or a gas bubble sealed in a liquid-tight bag can serve as flotation material 20. Obviously, if the package envelope is made of a floating material, such as, for example, polystyrene, less flotation material 20 will be required. A sealed envelope top 22 carries advertising materials, though advertising labels can be attached to its surface as an option. One end of a string 24 is attached to top 22 and the other end is attached to a conventional label 26. As an alternative, string 24 can be attached to partition 12 instead of to top 22.

OPERATION—FIRST EMBODIMENT—FIG. 1

When the infusion package is placed in a hot extracting liquid, usually water, flotation compartment 18, due to flotation material 20, stays partly submerged near the surface of the liquid and prevents the package envelope from sinking. The envelope floats in a substantially vertical position, so that top 22 and the opposite lower end of the package are substantially vertically separated. Top 22 projects above the surface of the liquid, and raw material compartment 10 is suspended in the upper hottest layers thereof, which are stirred freely by convection. This assures that the advertising on top 22 is highly visible, and the infusion of prepared raw material 16 into the liquid occurs faster and more completely. The projection of top 22 above the surface of the liquid provides also easy handling of the envelope, i.e., the user can agitate it or remove it from the liquid easily if desired. The agitation and removal can be done also with the help of string 24. Label 26 provides additional space for advertising materials. If string 24 is attached to partition 12, tugging at string 24 will swing compartment 10, providing another manner of agitation of raw material 16.

DESCRIPTION—DUAL INFUSION MATERIAL PACKAGE—FIGS. 2, 2A

Figure 2:
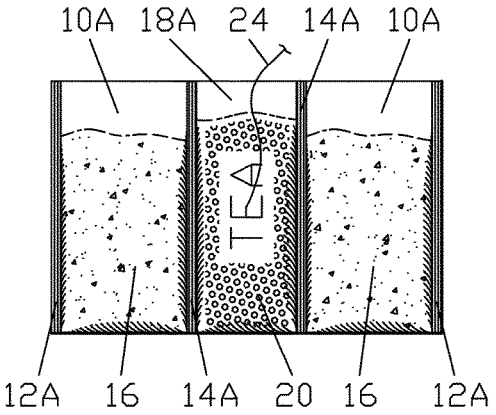
FIG. 2 is a plan view of an alternative embodiment of the infusion package.
Figure 2A:
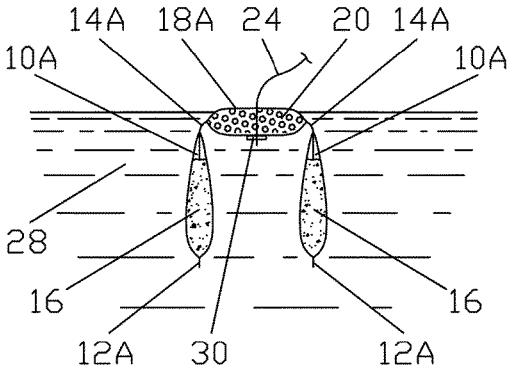
FIG. 2A is a cross-section of the infusion package shown in FIG. 2, immersed in a liquid.

Like the first embodiment of FIG. 1, the infusion package of FIGS. 2 and 2A is made of a liquid-permeable flat paper sleeve. The same alternative materials can be used for the package. FIG. 2 shows a plan view of the infusion package and FIG. 2A shows a cross section of it immersed in liquid 28. The package comprises two prepared raw material compartments 10A and an intermediate flotation compartment 18A. The compartments are formed and separated from each other by sealed partitions 12A and 14A. Compartments 10A contain prepared raw material 16. Compartments 10A may contain different raw materials, such as tea and sugar, coffee and dry cream, different herbs, etc. Compartment 18A is filled with flotation material 20. String 24 goes through the centers of the upper and lower walls of compartment 18A and is attached to a round pad 30 (FIG. 2A) under compartment 18A. Pad 30 can be made of the same materials as the envelope itself. The other end of string 24 is attached to a conventional label (not shown but similar to label 26 of FIG. 1). The upper wall of compartment 18A carries advertising materials, though an advertising label can be attached to its surface as an alternative.

OPERATION—DUAL INFUSION MATERIAL PACKAGE—FIG. 2A

When the infusion package is placed in a hot extracting liquid, flotation compartment 18A, due to flotation material 20, stays partly submerged near the surface of liquid 28 and prevents the package envelope from sinking. Consequently, raw material compartments 10A hang in substantially vertical positions in the hottest layers of liquid 28, which contact all their surfaces and are stirred freely by convection. As a result, the infusion of prepared raw material 16 into liquid 28 occurs faster and more completely. The projection of the upper wall of compartment 18A above the surface of liquid 28 assures that the advertising materials placed on it are highly visible. By tugging at string 24, one can easily agitate or remove the envelope from liquid 28. Pad 30 prevents damage of the package walls and consequent pulling out of string 24 from the envelope. The label at the end of string 24 (not shown) provides additional space for advertising.

DESCRIPTION—DUAL FLOATATION MATERIAL PACKAGE—FIGS. 3, 3A

Figure 3:
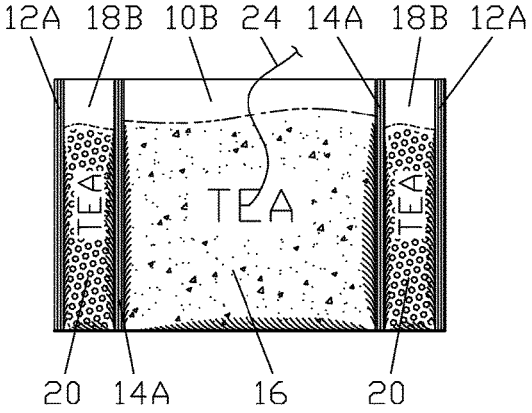
FIG. 3 is a plan view of another alternative embodiment of the infusion package.
Figure 3A:
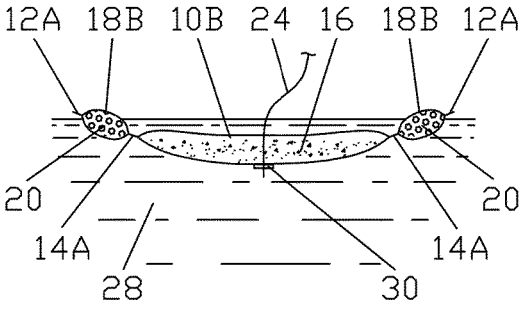
FIG. 3A is a cross section of the infusion package shown in FIG. 3, immersed in a liquid.

FIGS. 3 and 3A show a plan view of another embodiment of the infusion package and a cross section of it immersed in liquid 28. This embodiment is similar to the one in FIGS. 2 and 2A. The main difference is that this embodiment comprises one prepared raw material compartment 10B disposed between two flotation compartments 18B. Correspondingly, string 24 goes through the centers of the upper and lower walls of compartment 10B. The whole upper wall of the package envelope carries advertising materials, though advertising labels can be attached to its surface as an alternative. All other parts and materials are the same as in the embodiment of FIGS. 2 and 2A.

OPERATION—DUAL FLOATATION MATERIAL PACKAGE—FIG. 3A

When the infusion package is placed in a hot extracting liquid, flotation compartments 18B, due to flotation material 20, float partly submerged near the surface of liquid 28 and prevent the package envelope from sinking. Prepared raw material compartment 10B stays in a substantially horizontal position at or near the surface of liquid 28, in its hottest layers. These layers contact all surfaces of compartment 10B and are stirred by convection. As a result, the infusion of prepared raw material 16 into liquid 28 occurs faster and more completely. The upper walls of compartments 18B project above the surface of liquid 28. This, along with the horizontal position of compartment 10B, assures that the advertising placed on the upper wall of the envelope is well visible. The functions of string 24, pad 30 and label 26 are the same as in FIG. 2A.

DESCRIPTION—ROUND PACKAGE—FIG. 4

Figure 4:
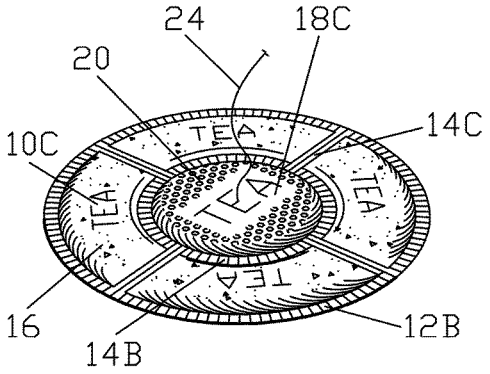
FIG. 4 is a perspective view of another alternative embodiment of the infusion package.

FIG. 4 shows a round infusion package manufactured by attaching together of the upper and lower envelope walls made of same or different materials. This embodiment can be made of the same materials as the embodiments described earlier. The upper wall can be also of a liquid-tight plastic film. The package comprises four prepared raw material compartments 10C formed by sealed partitions 12B, 14B and 14C and containing prepared raw material 16. In general, compartments 10C may contain different raw materials since partitions 14C separate them from each other. Partition 14B separates compartments 10C from a flotation compartment 18C filled with flotation material 20. The upper wall of the envelope carries advertising materials, though advertising labels can be attached to its surface as an option. One end of string 24 goes through the centers of the upper and lower walls of compartment 18C and is attached to a round pad (not shown but similar to pad 30 of FIG. 2A) under compartment 18C. A conventional label (not shown but similar to label 26 of FIG. 1) is attached to the other end of string 24.

OPERATION—ROUND PACKAGE—FIG. 4

Operation of this embodiment is essentially the same as of the one in FIGS. 2 and 2A. The only difference is that in this embodiment, due to partitions 14C separating adjacent raw material compartments 10C, the latter maintain intermediate positions between horizontal and vertical ones in liquid 28. Partitions 14C also prevent congregation of prepared raw material 16 in one place, resulting from storage of the embodiment in a vertical position. Such congregation could hinder the embodiment to assume proper position in liquid 28. If the upper wall of the envelope is made of the liquid-tight plastic film, it provides additional retention of heat and flavor of the beverage in liquid 28 during the infusion.

CONCLUSION, RAMIFICATIONS AND SCOPE

Accordingly the reader will see that the infusion packages of the various embodiments provide easy and trouble-free manufacturing, storage and use. They have one or more of the following advantages:

a) Manufacturing of all embodiments is similar to manufacturing of conventional infusion packages. It essentially requires only the addition of, for example, split cork in a separate compartment made in a conventional infusion package. This operation is very similar to adding a tea blend in another compartment.

b) Since, during infusion, the prepared raw material enclosed in a package is extracted more quickly and completely, its amount can be reduced. Because of this, and because the prepared raw material is the most expensive item in the package, the production cost and retail price of the package should be lower.

c) The storage of all embodiments is identical to the storage of conventional packages, as they have similar dimensions and all the materials inside them do not contact and adversely influence each other.

d) The use of all embodiments is as easy and trouble-free as the use of conventional packages. This is because the floatation material is disposed inside the embodiments and separately from the prepared raw materials. Hence there is no risk of beverage littering with the floatation material pieces, and the floatation and prepared raw materials do not contact and adversely influence each other during infusion.

e) The use of all embodiments is enjoyable, as one can study the advertising or funny pictures disposed at the package surface, and tug at the string.

While the above description contains many specificities, these should not be construed as limitations on the scope of any embodiment, but as exemplifications of the presently preferred embodiments thereof. Many other ramifications and variations are possible within the teachings of the various embodiments. For example, each of the embodiments described can comprise additional raw material compartments providing room for different raw materials or additives like coffee, sugar, dry cream, flavorings, herbs, etc. Any infusion material in lieu of tea and a herbal infusion can be used, such as fruit drink powders and sugar, soups, medicines, etc. The upper walls of the alternative embodiments can be made of a liquid-tight plastic film to provide additional retention of heat and flavor of the beverage in liquid 28 during the infusion. The embodiments can have other shapes, such as round, oval, trapezoidal, triangular, etc. The flotation and raw material compartments of the round package in FIG. 4 can switch places, so that one compartment 10C will be surrounded by four compartments 18C and will float in sufficiently horizontal position. All embodiments can comprise liquid-tight chambers filled with gas, for example air, which can serve as floatation compartments. Thus, in the mentioned variant of the round package of FIG. 4, where the compartments switched places, the raw material compartment 10C may be surrounded by a ring chamber filled with air.

Thus the scope of the invention should be determined by the appended claims and their legal equivalents, and not by the examples given.

I claim:

1. An infusion package comprising:

a sleeve, including at least one prepared raw material compartment and at least one floatation compartment formed therein to define a monolithic unit;

wherein the sleeve is constructed of a liquid-permeable material;

wherein the at least one prepared raw material compartment is defined by sealed partitions formed in the sleeve and contains therein a quantity of prepared raw material to be immersed into a liquid; and wherein the at least one floatation compartment is defined by sealed partitions formed in the sleeve and contains therein an inert floatation material.

2. An infusion package according to claim 1 further comprising a string connected to the sleeve; and wherein the string is attached at a first end to the sealed partition and is attached at a second end to a label.

3. An infusion package according to claim 1 wherein the sleeve includes a sealed package top at a first end thereof; and wherein the flotation compartment is formed between the sealed package top and the raw material compartment.

4. An infusion package according to claim 3 further comprising a string connected to the sleeve; and wherein the string is attached at a first end to the sealed package top and is attached at a second end to a label.

5. An infusion package according to claim 1 further comprising a pad and a string connected to the sleeve; wherein the at least one raw material compartment comprises two raw material compartments; wherein the at least one floatation compartment comprises one floatation compartment; wherein the floatation compartment is formed between the two raw material compartments so that the two raw material compartments are separated from one another by the floatation compartment and so that the two raw material compartments and the floatation compartment are separate and distinct from one another and so that, when immersed into the liquid, the two raw material compartments are submerged and the floatation compartment is only partially submerged; wherein the string transects the floatation compartment; and wherein the string is attached at a first end to the pad and is attached at a second end to a label.

6. An infusion package according to claim 1 further comprising a pad and a string connected to the sleeve; wherein the at least one floatation compartment comprises two floatation compartments; wherein the at least one raw material compartment comprises one raw material compartment; wherein the raw material compartment is formed between the two floatation compartments so that the two flotation compartments are separated from one another by the raw material compartment and so that the two floatation compartments and the raw material compartment are separate and distinct from one another and so that, when immersed into the liquid, the one raw material compartment is submerged between the two floatation compartments that are only partially submerged; wherein the string transects the raw material compartment; and wherein the string is attached at a first end to the pad and is attached at a second end to a label.

7. An infusion package according to claim 1 further comprising a pad and a string connected to the sleeve; wherein the sleeve has a substantially circular shape; wherein the at least one floatation compartment comprises one floatation compartment formed adjacent a medial portion of the substantially circular sleeve; wherein the at least one raw material compartment comprises a plurality of raw material compartments formed substantially surrounding the floatation compartment so that the plurality of raw material compartments substantially form a circumference of the substantially circular sleeve; wherein the flotation compartment is separated from the plurality of raw material compartments and so that the floatation compartment and the plurality of raw material compartments are separate and distinct from one another and so that, when immersed into the liquid, the plurality of raw material compartments are submerged and the one floatation compartment is only partially submerged; wherein the string transects the floatation compartment; and wherein the string is attached at a first end to the pad and is attached at a second end to a label.

8. An infusion package according to claim 1 further comprising a pad and a string connected to the sleeve; wherein the sleeve has a substantially circular shape; wherein the at least one raw material compartment comprises one raw material compartment formed adjacent a medial portion of the substantially circular sleeve; wherein the at least one flotation compartment comprises a plurality of floatation compartments formed substantially surrounding the raw material compartment so that the plurality of floatation compartments substantially form a circumference of the substantially circular sleeve; wherein the raw material compartment is separated from the plurality of floatation compartments so that the raw material compartment and the plurality of floatation compartments are separate and distinct from one another and so that, when immersed into the liquid, the one raw material compartment is submerged and the plurality of floatation compartments are only partially submerged; wherein the string transects the raw material compartment; and wherein the string is attached at a first end to the pad and is attached at a second end to a label.

9. An infusion package according to claim 1 wherein advertising material is displayed on at least one surface selected from the group consisting of a top surface of the sleeve or a visible surface of the sealed package top.

10. An infusion package comprising a sleeve, including at least one prepared raw material compartment and at least one floatation compartment formed therein to define a monolithic unit;

wherein the sleeve is constructed of a floatable material;

wherein the at least one prepared raw material compartment is defined by seared partitions formed in the sleeve and contains therein a quantity of prepared raw material adapted to be immersed into a liquid;

wherein the at least one floatation compartment is defined by sealed partitions formed in the sleeve and contains therein an inert floatation material; and wherein the at least one prepared raw material compartment is formed separate and distinct from the at least one floatation compartment.

11. An infusion package according to claim 10 further comprising a pad and a string connected to the sleeve; wherein the at least one raw material compartment comprises two raw material compartments; wherein the at least one floatation compartment comprises one floatation compartment; wherein the floatation compartment is formed between the two raw material compartments so that the two raw material compartments are separated from one another by the floatation compartment and so that the two raw material compartments and the floatation compartment are separate and distinct from one another and so that, when immersed into the liquid, the two raw material compartments are submerged and the floatation compartment is only partially submerged; wherein the string transects the floatation compartment; and wherein the string is attached at a first end to the pad and is attached at a second end to a label.

12. An infusion package according to claim 10 wherein advertising material is displayed on at least one surface selected from the group consisting of a top surface of the sleeve or a visible surface of the sealed package top.

13. An infusion package according to claim 10 further comprising a pad and a string connected to the sleeve; wherein the at least one floatation compartment comprises two floatation compartments; wherein the at least one raw material compartment comprises one raw material compartment; wherein the raw material compartment is formed between the two floatation compartments so that the two flotation compartments are separated from one another by the raw material compartment and so that the two floatation compartments and the raw material compartment are separate and distinct from one another and so that, when immersed into the liquid, the one raw material compartment is submerged between the two floatation compartments that are only partially submerged; wherein the string transects the raw material compartment; and wherein the string is attached at a first end to the pad and is attached at a second end to a label.

14. An infusion package according to claim 10 further comprising a pad and a string connected to the sleeve; wherein the sleeve has a substantially circular shape; wherein the at least one floatation compartment comprises one floatation compartment formed adjacent a medial portion of the substantially circular sleeve; wherein the at least one raw material compartment comprises a plurality of raw material compartments formed substantially surrounding the floatation compartment so that the plurality of raw material compartments substantially form a circumference of the substantially circular sleeve; wherein the floatation compartment is separated from the plurality of raw material compartments and so that the floatation compartment and the plurality of raw material compartments are separate and distinct from one another and so that, when immersed into the liquid, the plurality of raw material compartments are submerged and the one floatation compartment is only partially submerged; wherein the string transects the floatation compartment; and wherein the string is attached at a first end to the pad and is attached at a second end to a label.

15. An infusion package according to claim 10 further comprising a pad and a string connected to the sleeve; wherein the sleeve has a substantially circular shape; wherein the at least one raw material compartment comprises one raw material compartment formed adjacent a medial portion of the substantially circular sleeve; wherein the at least one floatation compartment comprises a plurality of floatation compartments formed substantially surrounding the raw material compartment so that the plurality of floatation compartments substantially form a circumference of the substantially circular sleeve; wherein the raw material compartment is separated from the plurality of floatation compartments so that the raw material compartment and the plurality of floatation compartments are separate and distinct from one another and so that, when immersed into the liquid, the one raw material compartment is submerged and the plurality of floatation compartments are only partially submerged; wherein the string transects the raw material compartment; and wherein the string is attached at a first end to the pad and is attached at a second end to a label.

16. An infusion package comprising:

a flat sleeve, including at least one prepared raw material compartment and at least one floatation compartment formed therein; and a string connected to the flat sleeve:

wherein the flat sleeve includes a top layer and a bottom layer joined together at the edges thereof;

wherein the top layer is constructed of a liquid-tight material and the bottom layer is constructed of a liquid-permeable material;

wherein the prepared raw material compartment is defined by sealed partitions formed in the sleeve and contains therein a quantity of prepared raw material adapted to be immersed into a liquid;

wherein the floatation compartment is defined by sealed partitions formed in the sleeve and contains therein an inert floatation material; and wherein the at least one prepared raw material compartment is formed separate and distinct from the at least one floatation compartment.

17. An infusion package according to claim 16 wherein the at least one raw material compartment comprises two raw material compartments; wherein the at least one floatation compartment comprises one floatation compartment; and wherein the floatation compartment is formed between the two raw material compartments so that the two raw material compartments are separated from one another by the floatation compartment and so that the two raw material compartments and the floatation compartment are separate and distinct from one another and so that, when immersed into the liquid, the two raw material compartments are submerged and the floatation compartment is only partially submerged.

18. An infusion package according to claim 16 wherein the at least one floatation compartment comprises two floatation compartments; wherein the at least one raw material compartment comprises one raw material compartment; and wherein the raw material compartment is formed between the two floatation compartments so that the two flotation compartments are separated from one another by the raw material compartment and so that the two floatation compartments and the raw material compartment are separate and distinct from one another and so that, when immersed into the liquid, the one raw material compartment is submerged between the two floatation compartments that are only partially submerged.

19. An infusion package according to claim 16 wherein the sleeve has a substantially circular shape; wherein the at least one flotation compartment comprises one floatation compartment formed adjacent a medial portion of the substantially circular sleeve; wherein the at least one raw material compartment comprises a plurality of raw material compartments formed substantially surrounding the floatation compartment so that the plurality of raw material compartments substantially form a circumference of the substantially circular sleeve; and wherein the flotation compartment is separated from the plurality of raw material compartments and so that the floatation compartment and the plurality of raw material compartments are separate and distinct from one another and so that, when immersed into the liquid, the plurality of raw material compartments are submerged and the one floatation compartment is only partially submerged.

20. An infusion package according to claim 16 wherein the sleeve has a substantially circular shape; wherein the at least one raw material compartment comprises one raw material compartment formed adjacent a medial portion of the substantially circular sleeve; wherein the at least one flotation compartment comprises a plurality of floatation compartments formed substantially surrounding the raw material compartment so that the plurality of floatation compartments substantially form a circumference of the substantially circular sleeve; and wherein the raw material compartment is separated from the plurality of floatation compartments so that the raw material compartment and the plurality of floatation compartments are separate and distinct from one another and so that, when immersed into the liquid, the one raw material compartment is submerged and the plurality of floatation compartments are only partially submerged.

21. An infusion package according to claim 1 wherein the inert floatation material includes pieces of floatation material, which are inert and harmless in the liquid.

22. An infusion package according to claim 10 wherein the inert floatation material includes pieces of floatation material, which are inert and harmless in the liquid.

23. An infusion package according to claim 16 wherein the inert floatation material includes pieces of floatation material, which are inert and harmless in the liquid.

* * * * *